US011454092B2

(12) United States Patent
Quazi et al.

(10) Patent No.: US 11,454,092 B2
(45) Date of Patent: Sep. 27, 2022

(54) DETERMINING GROUND LOOP RESISTANCE WITH GROUND SOURCE HEAT PUMP MONITORING DATA

(71) Applicant: Dandelion Energy, Inc., Palo Alto, CA (US)

(72) Inventors: Rajeev James Quazi, Hasting on Hudson, NY (US); Ryan Joseph Carda, Brookings, SD (US); Brian Lee Zimmerly, Brooklyn, NY (US)

(73) Assignee: Dandelion Energy, Inc., New York, NY (US)

( * ) Notice: Subject to any disclaimer, the term of this patent is extended or adjusted under 35 U.S.C. 154(b) by 599 days.

(21) Appl. No.: 16/438,290

(22) Filed: Jun. 11, 2019

(65) Prior Publication Data

US 2019/0383118 A1 Dec. 19, 2019

Related U.S. Application Data

(60) Provisional application No. 62/684,521, filed on Jun. 13, 2018.

(51) Int. Cl.

| | |
|---|---|
| ***E21B 36/00*** | (2006.01) |
| ***E21B 47/07*** | (2012.01) |
| ***E21B 47/103*** | (2012.01) |

(52) U.S. Cl.

CPC ..... *E21B 36/006* (2013.01); *E21B 47/07* (2020.05); *E21B 47/103* (2020.05)

(58) Field of Classification Search

CPC ..... E21B 36/006; E21B 47/07; E21B 47/103; E21B 49/00

See application file for complete search history.

(56) References Cited

U.S. PATENT DOCUMENTS

2011/0238362 A1* 9/2011 Kidwell ..... G06F 15/00 702/136
2012/0080163 A1* 4/2012 Hoffman ..... F24J 3/08 165/45

OTHER PUBLICATIONS

"Ground Source Heat Pump Residential and Light Commercial: Design and Installation Guide", 2nd Printing Aug. 2011, Author: Charles Remund, Oklahoma State University (Year: 2011).*
Anonymous "IGSHPA Design and Installation Guide, Chapters 5 and 11", Oklahoma State University, 2009, 137 pages.
Anonymous "IGSHPA Grouting For Vertical Geothermal Heat Pump Systems", Oklahoma State University, 2009, 21 pages.

* cited by examiner

*Primary Examiner* — Tarun Sinha
*Assistant Examiner* — Lal C Mang
(74) *Attorney, Agent, or Firm* — Fountainhead Law Group P.C.

(57) ABSTRACT

In some embodiments, a method operates a heat pump that uses a ground loop to perform heating or cooling in a site. During the operating of the heat pump over a time period: the method measures a first series of measurements of a ground loop water flow rate by the heat pump; a second series of measurements of a ground loop fluid temperature for the heat pump; and measures a third series of measurements of a local soil or deep earth temperature. The first measurement, the second measurement, and the third measurement are outputted where a ground loop thermal resistance value is calculated for the heat pump based on the first measurement, the second measurement, and the third measurement.

20 Claims, 9 Drawing Sheets

DETERMINING GROUND LOOP RESISTANCE WITH GROUND SOURCE HEAT PUMP MONITORING DATA

CROSS REFERENCE TO RELATED APPLICATIONS

Pursuant to 35 U.S.C. § 119(e), this application is entitled to and claims the benefit of priority to, and the filing date of, U.S. Provisional App. No. 62/684,521 filed Jun. 13, 2018, the content of which is incorporated herein by reference in its entirety for all purposes.

BACKGROUND

A ground loop for a ground source heat pump (GSHP) system typically includes a certain number of bores that are drilled into the earth to a specified depth. The number and depth of bores required to serve a given ground source heat pump system are a function of a number of factors, such as the peak heating and cooling loads for the space or building, the installed equipment capacity and anticipated run-time, the annual energy requirements for the building, and the thermal properties of the ground at the project site, among other things.

In terms of ground thermal properties, thermal conductivity (TC) and temperature are sometimes central factors for design. Of these parameters, ground thermal conductivity may be the most difficult to quantify, and may represent the greatest amount of uncertainty for the system designer. Ground thermal conductivity may have a direct impact, and can be a critical parameter, in calculating the number and depth of vertical bores necessary for a given system. As such, an accurate determination of ground thermal conductivity may be important for designing a cost-effective and well-functioning ground source heat pump system.

Currently, two methods to estimate or measure ground thermal conductivity in a given location are as follows: 1) perform an in-situ thermal conductivity test; or 2) estimate properties based on a nearby drill log or other publicly available information sources that describe the soil or rock type present in an area. Both of these existing methods have their drawbacks.

In-situ testing may require the installation of a geothermal test bore on the project site so that ground thermal conductivity can be measured directly. Test bores are typically installed before the ground loop design can be completed or finalized. As such, the project site is not typically prepared for the installation of the entire ground loop due to the timing of when test bore installation takes place. The drilling contractor may be required to include mobilization, logistics, and site preparation costs into the installation of a single bore. Economies of scale that are associated with large projects including multiple bores may not apply to bore installations for testing. Once the test bore has been installed, in-situ testing requires the use of specialized equipment with data acquisition capabilities, a diesel generator, and a specially trained technician over a 48-hour time period. Because of all of these factors, in-situ thermal conductivity testing is very expensive and cost prohibitive for many projects. Further, test bore locations are sparse and the data and corresponding results are not publicly available.

The current method of estimating ground thermal conductivity using drill logs or other public sources of information presents its own challenges to the system designer. Geological maps are published at low resolution, resulting in low precision estimates of soil/rock type in an area without enough detail to make an accurate conclusion. Further, ground thermal conductivity is not only a function of the soil or rock types in a given area, but also of the density and moisture content of those materials. In many cases, a vertical bore in a given location will pass through multiple layers of soil and rock of varying thickness, density, and moisture levels. Factors such as porosity, static water level, and subsurface water movement add another layer of complexity to the process of estimating ground thermal conductivity value. None of these key pieces of information are guaranteed to be included in public data sources.

Once ground thermal conductivity is known, the next step in the design process is to calculate an overall ground loop thermal resistance value, which represents the combined heat transfer properties of the ground loop pipes, bore annulus, and surrounding ground thermal conductivity and also accounts for their geometry (spacing, diameter, etc.). Current methods to calculate the overall ground loop thermal resistance value, which accounts for these factors, are subject to error. They are not only dependent on being able to accurately quantify ground thermal conductivity value, but also in knowing the exact placement and spacing of the ground loop pipes in the bore itself.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, makes apparent to those of skill in the art how embodiments in accordance with the present disclosure may be practiced. Similar or same reference numbers may be used to identify or otherwise refer to similar or same elements in the various drawings and supporting descriptions. In the accompanying drawings.

DETAILED DESCRIPTION

Figure 1A:
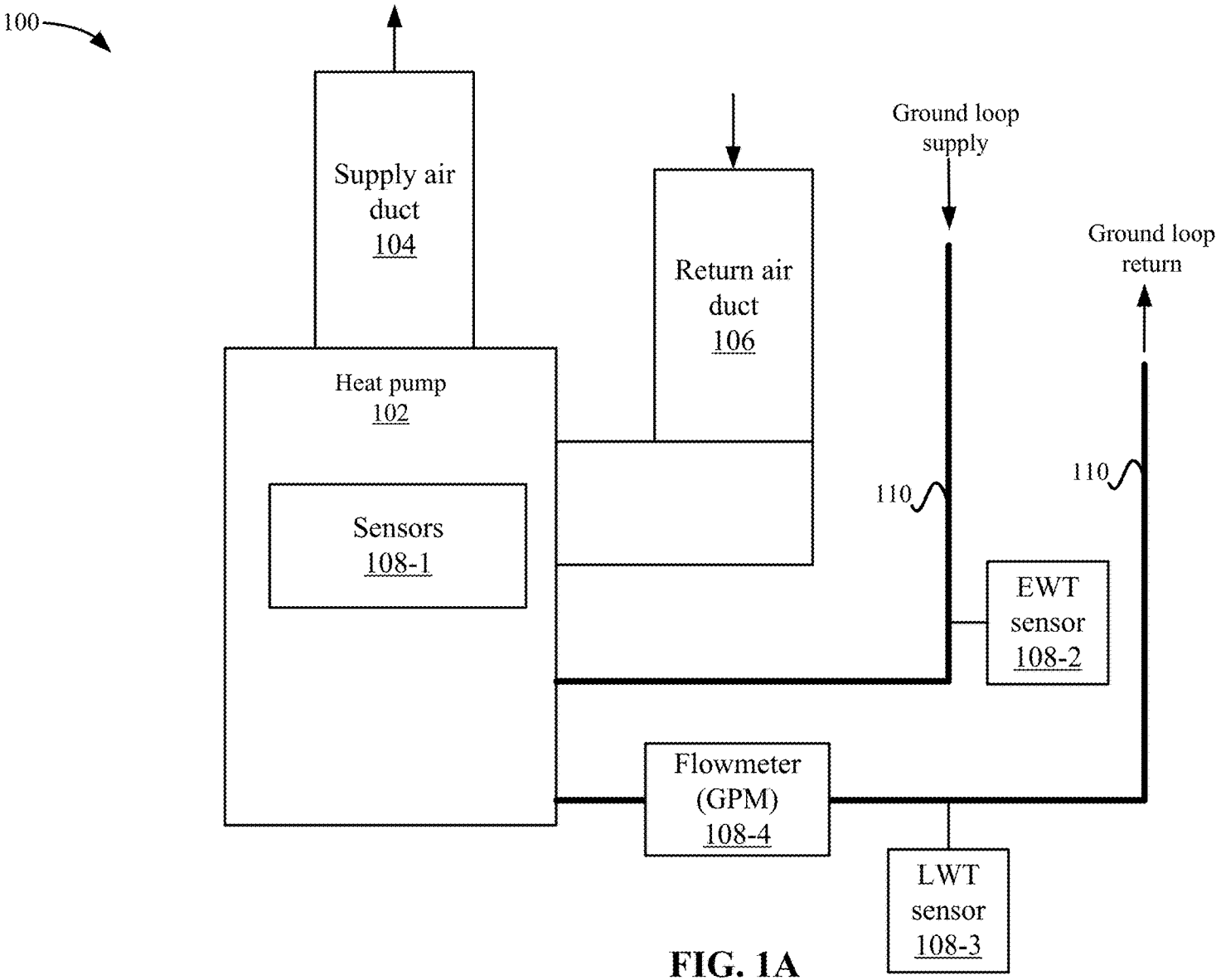
FIG. 1A depicts a simplified heat pump system according to some embodiments.

In the following description, for purposes of explanation, numerous examples and specific details are set forth in order to provide a thorough understanding of the present disclosure. Such examples and details are not to be construed as unduly limiting the elements of the claims or the claimed subject matter as a whole. It will be evident to one skilled in the art, based on the language of the different claims, that the claimed subject matter may include some or all of the features in these examples, alone or in combination, and may further include modifications and equivalents of the features and techniques described herein.

Some embodiments disclose a method to quickly and accurately determine the ground loop thermal resistance at a given location to vastly improve the accuracy of a geothermal heat pump system design as a whole. More specifically, aspects of the present disclosure relate to the use of geothermal heat pump system monitoring and performance data to calculate ground loop thermal resistance values. Although ground loop thermal resistance is discussed, ground loop thermal conductivity may also be calculated. Some embodiments directly measure the overall ground loop thermal resistance value without requiring any knowledge of the environmental factors, such as soil properties, bore construction or bore geometry, such as pipe sizing, placement or spacing in the bore annulus. Further, aspects of the present disclosure relate to the aggregation and mapping of calculated ground loop thermal resistance values to predict thermal resistance values at future sites so that ground loop design lengths can also be determined at the future sites.

Embodiments of the present disclosure may quickly, accurately, and inexpensively calculate a ground loop thermal resistance value using measured data, and may then predict values for surrounding project sites, for example. Accordingly, guesswork and error may be removed from geothermal system design in general. The prediction capability also allows for integrating the aggregated network of thermal resistance values into geothermal design tools to provide high fidelity prediction capability for design lengths of ground loops (e.g., bore lengths) and subsequent installation costs to be mapped out by region. For example, homeowners may be provided with an accurate depiction of installation costs in their area to gauge return on investment. Similarly, policymakers and utility providers could gauge the potential impact of rebates, incentives and rate structures for geothermal heat pump installations.

The present disclosure introduces a method that uses measured data to empirically derive the ground loop thermal resistance value across a long term continuous set of operating conditions at a given project site in place of estimates, expensive test procedures, or theoretical models. In one embodiment, the present disclosure includes a system using real-time, on-site measurements of heat pump performance, ground temperature, and ground loop fluid temperature response as a result of normal geothermal heat pump system operation. Data is collected from the heat pump with an onboard sensor pack that is connected to an equipment monitoring software platform. By continuously monitoring the heat rejection or extraction rate to/from the ground loop, ground loop water flow rate, and the fluid temperature response over time, the overall ground loop thermal resistance value can be determined without knowing any information about the ground formation where the system is located.

Further, embodiments of the present disclosure may include a method of mapping the location and corresponding measured values to predict ground thermal resistance at future sites using an aggregated or mesh calculation approach. The method uses the map of known points combined with proprietary design variables, or weighting factors, to predict ground source heat pump ground loop design lengths, performance, savings, etc. based on measurements from nearby project sites. Prediction accuracy would improve over time as the number of installations increase.

FIG. 1A depicts a simplified system 100 of a heat pump system according to some embodiments. A heat pump 102 may be a geothermal heat pump or ground source heat pump (GSHP). Heat pump 102 may be used in a central heating and/or cooling system that transfers heat to or from the ground. Heat pump 102 uses the ground as a heat source (e.g., in the winter) or a heat sink (e.g., in the summer).

A supply air duct 104 provides air to a premises and a return air duct 106 receives air from the premises. Heat pump 202 can cool or heat the air received from return air duct 106 and provide the cooled or heated air to supply air duct 104.

Figure 1B:
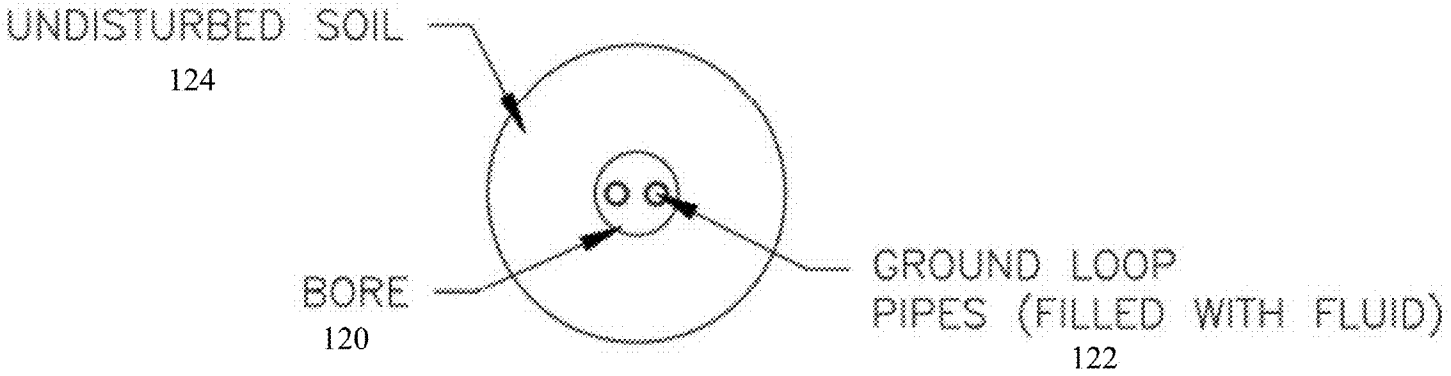
FIG. 1B shows a cross section of the ground loop according to some embodiments.

A ground loop 110 includes a certain number of bores drilled into the earth to a specified depth. Ground loop 110 circulates a ground loop fluid that is heated or cooled from the ground. FIG. 1B shows a cross section of the ground loop according to some embodiments. A bore 120 forms a hole in undisturbed soil 124. Within bore 120, ground loop pipes 122 are filled with fluid. The ground loop fluid temperature is monitored through ground loop pipes 122.

Heat pump 102 includes sensors 108 that can continuously monitor the operation of heat pump 102 with respect to its capacity, efficiency, and run time while at the same time monitoring the temperature response of the ground loop that it is connected to. Sensors 108-1 may measure the local soil or deep earth temperature $T_{de}$, the density of the ground loop fluid $\rho_{fluid}$, the specific heat of the ground loop fluid $C_p$, and other measurements.

An EWT sensor 108-2 may measure a ground loop fluid temperature to enter heat pump 102, such as when operating under peak heating conditions (e.g., a minimum ground loop fluid temperature) and a LWT sensor 108-3 may measure a ground loop fluid temperature to leave the ground source heat pump, such as when operating under peak heating conditions (e.g., a minimum ground loop fluid temperature). A flowmeter sensor 108-4 may measure a ground loop water flow rate in ground loop 110. Although sensors 108-2, 108-3, and 108-4 are located outside of heat pump 102, the sensors may be located at different points in system 100. The configuration of heat pump 102 with these sensors to measure the operating parameters may then be used to empirically derive a value for ground loop thermal resistance value.

Figure 2:
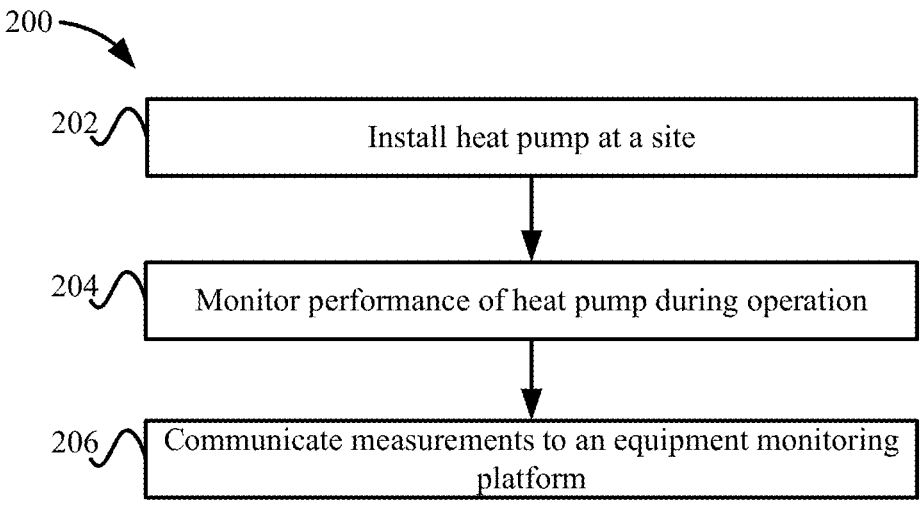
FIG. 2 depicts a simplified flowchart of a method for monitoring performance at a heat pump according to some embodiments.

FIG. 2 depicts a simplified flowchart 200 of a method for monitoring performance at heat pump 102 according to some embodiments. At 202, heat pump 102 is installed at a site. That is, heat pump 102 may be operating in real-time at a site in which an operating ground loop has been installed. This is different from drilling a test bore for solely measuring the thermal conductivity value.

At 204, sensors 108 monitor the performance of heat pump 102. As discussed above, sensors 108 may measure heat pump performance, ground temperature, and ground loop fluid temperature response as a result of the normal operation of heat pump 102.

At 206, heat pump 102 may communicate the measurements to an equipment monitoring platform. The equipment monitoring platform may be remotely located from heat pump 102, but may also be part of heat pump 102. Heat pump 102 may be equipped with communication system to communicate the measurements to the equipment monitoring platform. The equipment monitoring platform may then calculate the thermal conductivity value for the site. By continuously monitoring the measurements over time, the ground loop thermal resistance value can be determined without knowing any information about the ground formation where the system is located.

Figure 3:
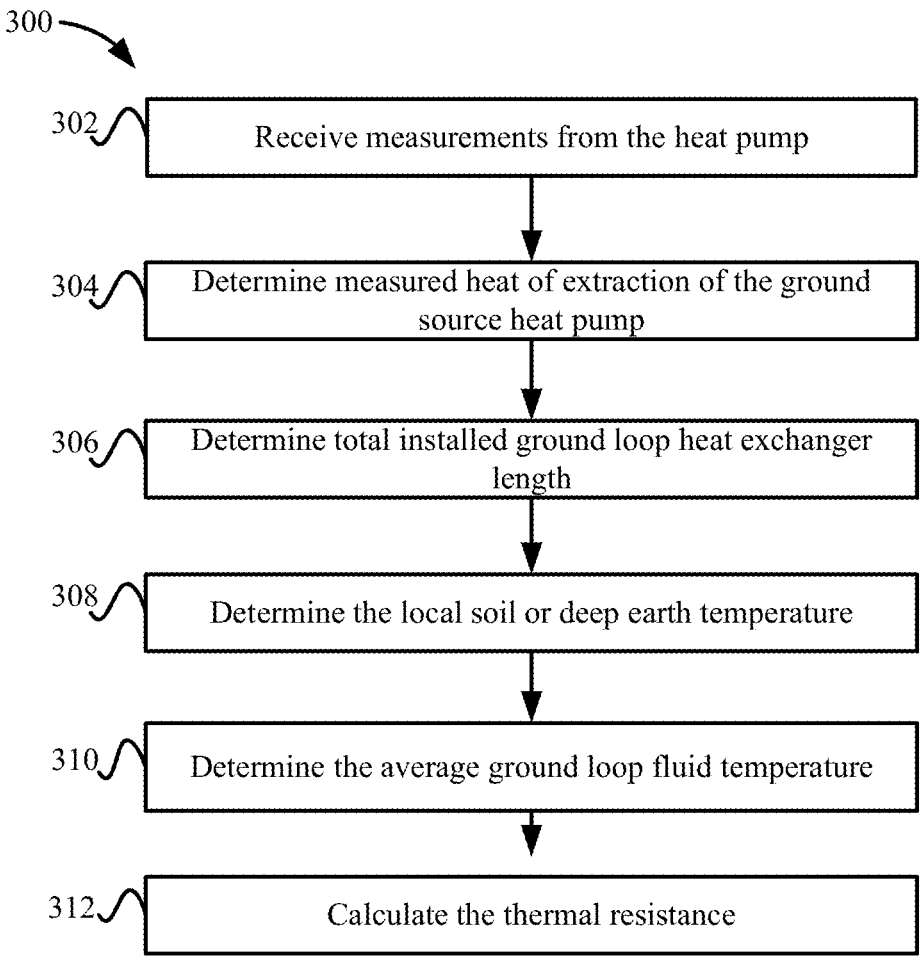
FIG. 3 depicts a simplified flowchart of a method for calculating the thermal resistance according to some embodiments.

FIG. 3 depicts a simplified flowchart 300 of a method for calculating the ground loop thermal resistance according to some embodiments. At 302, the equipment monitoring platform receives the measurements from heat pump 102. Then, at 304, the equipment monitoring platform determines the measured heat of extraction of heat pump 102. The heat of extraction may be measured in Btu/hr over a period of time and is an amount of heat that is extracted from ground loop 110.

At 306, the equipment monitoring platform determines the total installed ground loop heat exchanger length. This is a length of ground loop 110, such as the bore length, and may be set as a fixed value.

At 308, the equipment monitoring platform determines the local soil or deep earth temperature. This measurement measures the ground temperature in an area by ground loop 102.

At 310, the equipment monitoring platform determines the average ground loop fluid temperature. In some embodiments, the average ground loop fluid temperature is when heat pump 102 is operating under maximum load conditions, which may be when heat pump 102 is heating or cooling air from return air duct 106 at a maximum rate. The maximum load conditions may be used because a more accurate thermal resistance value is calculated when at the maximum load condition, which is a known condition of operation of heat pump 102. This value allows the design of the bore length and ground loop for a heat pump system that is operating at the maximum load.

At 312, the equipment monitoring platform calculates the thermal conductivity. For example, the equipment monitoring platform directly measures the overall ground loop thermal resistance value without requiring any knowledge of the soil properties, the bore construction, or the bore geometry, such as pipe sizing, placement or spacing in the bore annulus. This is achieved by monitoring the temperature response of the ground loop fluid entering/leaving heat pump 102 as part of normal system operation over time. The measured temperature response reflects the combined thermal performance of the soil, bore construction characteristics and geometry. Conventional methods to calculate ground loop thermal resistance require an estimate or direct measurement of soil thermal conductivity, coupled with the use of empirical formulas. The empirical formulas also require the use of simplifying assumptions of pipe placement, spacing, etc. in the bore annulus in order to determine number and depth of bores for a given system.

In some examples, the equipment monitoring platform uses a cylindrical line source equation as follows:

$$TR = \frac{L_{total} \cdot (T_{de} - AWT_{min})}{HE},$$

where:

Ground loop thermal resistance (TR)=total combined ground loop thermal resistance value, hr-ft-° F./Btu HE=measured heat of extraction of the ground source heat pump, Btu/hr $L_{total}$=total installed ground loop heat exchanger length, ft $T_{de}$=local soil, or deep earth temperature, ° F.

$AWT_{min}$=the average ground loop fluid temperature with the ground source heat pump operating under maximum load conditions, ° F.

In the above, a difference of the local soil, or deep earth temperature and the average ground loop fluid temperature is calculated and multiplied by the installed ground loop heat exchanger length to generate a denominator value. Then, the measured heat of extraction of heat pump 102 is divided by the denominator value.

The ground loop thermal resistance is the inverse of conductivity. However, the thermal resistance may also account for the properties of the material in addition to its geometry (e.g., thickness). The thermal resistance may be a combination of the ground loop pipe resistance, the bore resistance, and the undisturbed soil resistance. The measured temperature response in the ground loop estimates the above combination of resistances. The above values of the heat extraction, local soil or deep earth temperature, and the average ground loop fluid temperature are derived from measurements of sensors 108.

Figure 4:
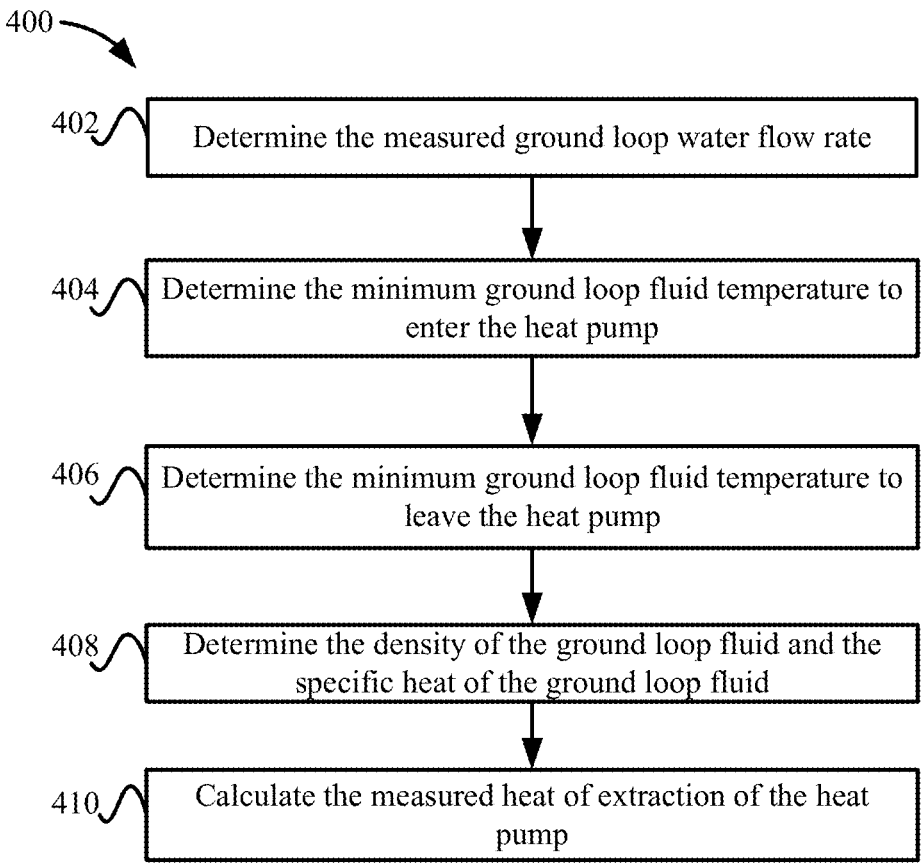
FIG. 4 depicts a simplified flowchart of a method for calculating the rate of heat extracted from the ground loop according to some embodiments.

The thermal resistance values are calculated using the rate of heat extracted from the ground loop. FIG. 4 depicts a simplified flowchart 400 of a method for calculating the rate of heat extracted from the ground loop according to some embodiments. At 402, the equipment monitoring platform determines the measured ground loop fluid flow rate. Sensor 108-4 may have measured the flow rate of the fluid in gallons/min (gal/min).

At 404, the equipment monitoring platform determines the minimum ground loop fluid temperature to enter heat pump 102. For example, the minimum ground loop fluid temperature to enter heat pump 102 when operating under peak heating conditions is calculated. In some embodiments, sensor 108-2 may measure the minimum ground loop fluid temperature to enter heat pump 102.

At 406, the equipment monitoring platform determines the minimum ground loop fluid temperature to leave heat pump 102. For example, the minimum ground loop fluid temperature to leave heat pump 102 when operating under peak heating conditions is calculated. In some embodiments, sensor 108-3 may measure the minimum ground loop fluid temperature to leave heat pump 102.

At 408, the equipment monitoring platform determines the density of the ground loop fluid and the specific heat of the ground loop fluid. Sensors 108-1 may perform these measurements.

At 410, the equipment monitoring platform calculates the measured heat of extraction of heat pump 102. The rate of heat extracted from the ground loop may be calculated as follows:

$$HE = GPM \cdot \frac{60\ \text{min}}{1\ hr} \cdot \frac{1\ \text{gal}}{7.4805\ \text{ft}^3} \cdot \rho_{fluid} \cdot C_p \cdot (EWT_{min} - LWT_{min})$$

Where:

GPM=measured ground loop water flow rate, gal/min $\rho_{fluid}$=density of the ground loop fluid, lb/ft$^3$ $C_p$=specific heat of the ground loop fluid, Btu/lb-° F.

$EWT_{min}$=minimum ground loop fluid temperature to enter the ground source heat pump when operating under peak heating conditions, ° F.

$LWT_{min}$=minimum ground loop fluid temperature to leave the ground source heat pump when operating under peak heating conditions, ° F.

In the above, the measured ground loop water flow rate is multiplied by the density of the ground loop fluid and the specific heat of the ground loop fluid to generate a first result. Then, a difference between the minimum ground loop fluid temperature to enter heat pump 102 and the minimum ground loop fluid temperature to leave heat pump 102 is multiplied by the first result. The ground loop water flow rate, the ground loop fluid temperature to enter heat pump 102 and the ground loop fluid temperature to leave heat pump 102 were directly measured by sensors 108.

Figure 5:
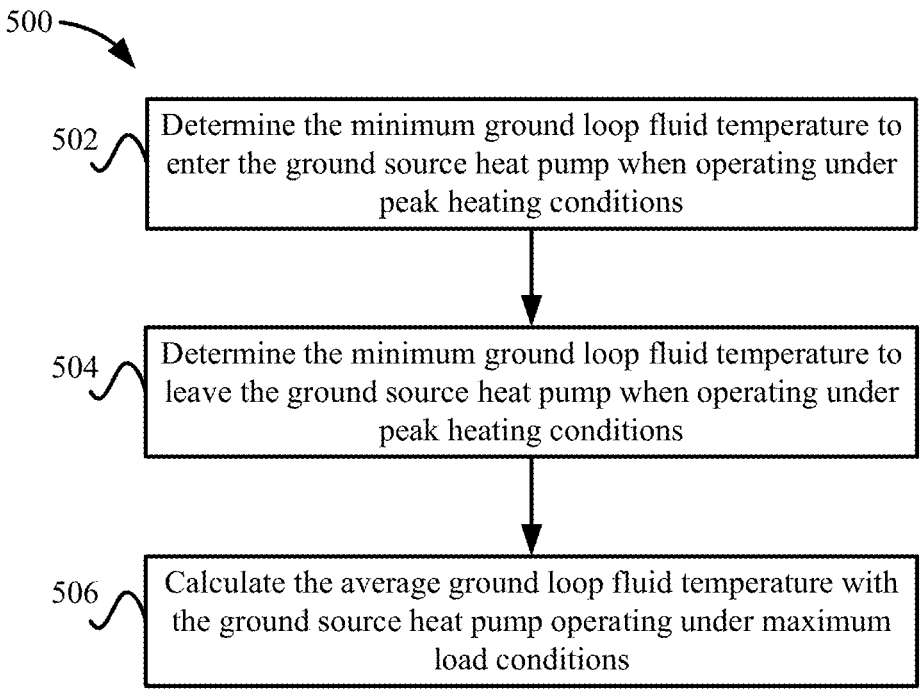
FIG. 5 depicts a simplified flowchart of a method for calculating the average ground loop fluid temperature in the ground loop according to some embodiments.

Also, the thermal resistance values are calculated using an average ground loop fluid temperature. FIG. 5 depicts a simplified flowchart 500 of a method for calculating the average ground loop fluid temperature in the ground loop according to some embodiments. At 502, the equipment monitoring platform determines the minimum ground loop fluid temperature to enter heat pump 102, such as when heat pump 102 is operating under peak heating conditions. At 504, the equipment monitoring platform determines the minimum ground loop fluid temperature to leave heat pump 102, such as when heat pump 102 is operating under peak heating conditions. At 506, the equipment monitoring platform calculates the average ground loop fluid temperature, such as when heat pump 102 is operating under maximum load conditions The average ground loop fluid temperature in the ground loop with the ground source heat pump operating under maximum load conditions may be calculated as follows:

$$AWT_{min} = \frac{EWT_{min} + LWT_{min}}{2}$$

The following is a sample calculation, but is not limiting:

Project Specific Data:

Location: Location #1

$T_{de}$=53° F.

$\rho_{fluid}$=64.3 lb/ft3

$C_p$=0.93 Btu/lb-° F.

Measured Data (During Ground Source Heat Pump Operation):

EWTmin=30° F.

LWTmin=25 F

Ground loop water flow=9 gal/min

Sample Calculations:

AWTmin=(30+25)/2=27.5° F.

HE=(9 gal/min)·(60 min/1 hr)·(1 gal/7.4805 ft$^3$)·(64.3 lb/ft3)·(0.93 Btu/lb-° F.)·(30° F.−25° F.)=21,584 Btu/hr Ground loop thermal resistance=[450 ft·(53° F.−27.5° F.)]/21,584 Btu/hr=0.532 hr-ft-° F./Btu The calculation methodology being presented to calculate ground thermal resistance value may change to improve accuracy over time. Additionally, although the sample calculations performed here are based on heating mode operation, the same calculations could also be performed during the summer cooling season.

For the purposes of this disclosure, the entering and leaving ground loop fluid temperature as well as the ground loop fluid flow rate may be continuously monitored as illustrated in FIG. 1, which depicts representative placement of the pertinent sensors 108-2, 108-3, and 108-4 as part of the ground source heat pump installation in addition to the measurements being taken.

Figure 6:
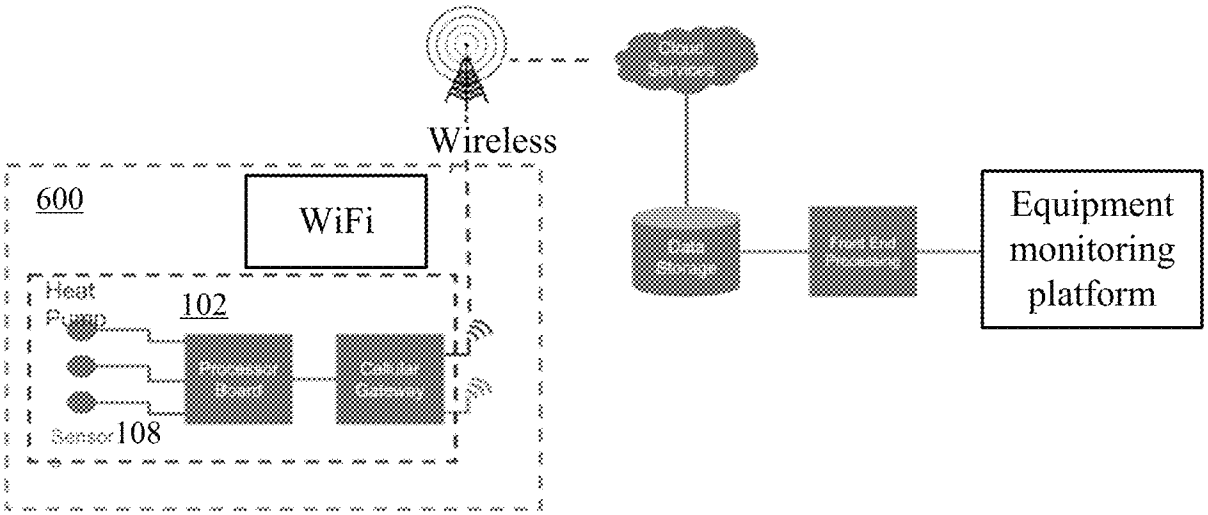
FIG. 6 depicts a system that illustrates remote and continuous monitoring of a ground source heat pump system to determine the combined ground loop thermal resistance value under peak heating or cooling conditions according to some embodiments.

In one embodiment, measurements from the ground source heat pump monitoring platform 600 would be remotely accessible through a WiFi or cellular network. FIG. 6 depicts a system that illustrates remote and continuous monitoring of a ground source heat pump system 600 to determine the combined ground loop thermal resistance value under peak heating or cooling conditions according to some embodiments. Heat pump 102 includes a communication system (e.g., a processor board and cellular gateway, or a WiFi connection) to communicate measurements to the equipment monitoring platform. Cloud services, data storage, and front end processing are used to continuously monitor and calculate the thermal resistance value.

Figure 7:
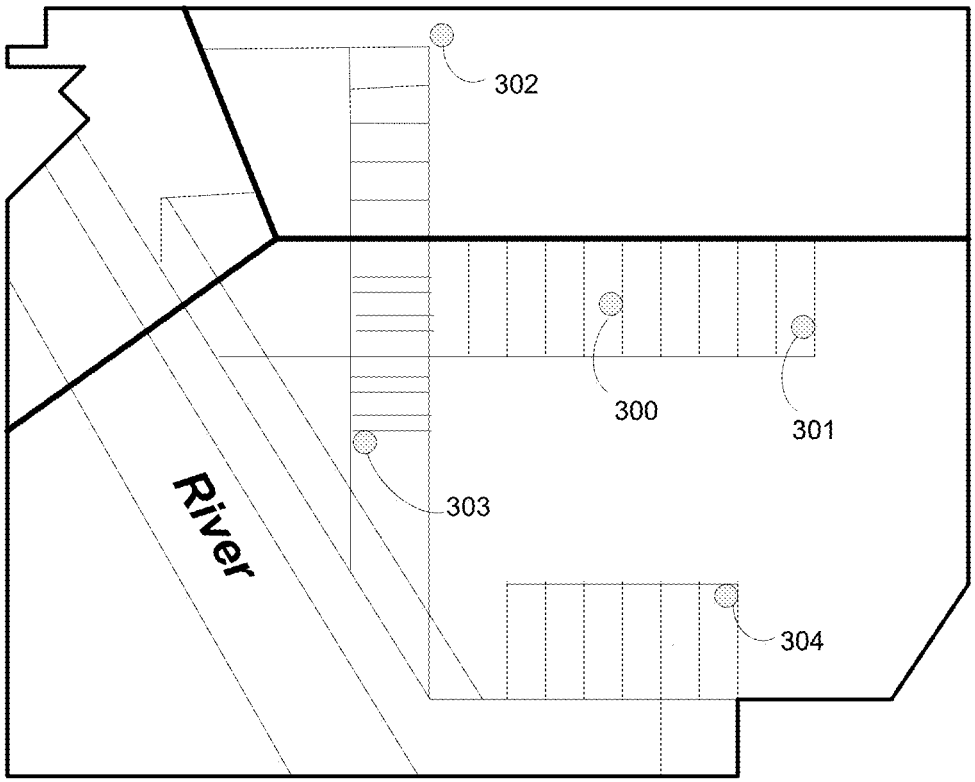
FIG. 7 illustrates a map (e.g., of a city and streets) with known data points and unknown data point according to some embodiments.

In addition to calculating ground thermal resistance values with ground source heat pump monitoring data, a process may be used to create a map or mesh of known data points to predict ground loop design lengths and geothermal heat pump performance for future sites. The process may automatically improve itself over time as the overall number and concentration of projects with installed heat pumps 102 in a given area increase. According to another aspect of the present disclosure, changes in ground loop resistance and subsequent performance due to factors such as changes in the height of the static water table or changes in subsurface water movement will also be detected. FIG. 7 illustrates a map (e.g., of a city and streets) with known data points 301-304 and unknown data point 300 according to some embodiments. The process uses known data points to predict ground loop thermal resistance at future sites. Data points 301-304 represent sample locations for existing ground source heat pump installations with available monitoring data and calculated ground loop thermal resistance values. Point 300 represents the location of a proposed ground source heat pump installation.

The process may predict the ground loop thermal resistance value for the proposed installation based on the measured values from the surrounding systems. The process calculates the predicted value based on a weighted average from nearby sites, which would consider factors such as: distance, elevation, USGS Soil Type, and/or depth to the static water table, for example. A sample calculation for predicted ground loop thermal resistance value at a future site is as follows:

SAMPLE TABLE OF KNOWN DATA POINTS WITH DISTANCE RELATIVE TO ESTIMATE FOR FUTURE SITE

| Label | Thermal Resistance Value (hr-ft-F/Btu) | XY, Distance from Future Site (ft) | Z, Elevation Difference from Future Site (ft) |
|---|---|---|---|
| Known Point 1 | 0.571 | 10,877 | 46 |
| Known Point 2 | 0.610 | 9,240 | 17 |
| Known Point 3 | 0.549 | 8,712 | 110 |
| Known Point 4 | 0.535 | 13,253 | 17 |
| Future Site | Unknown | 0 | 0 |

The process then may use the following to calculate the thermal conductivity for the future site:

$$\text{Estimated } TC = \sum_{i=1}^{n} \frac{\text{Known } TC_i}{Distance_i} \Big/ \sum_{i=1}^{n} \left(\frac{1}{Distance_i}\right)$$

Where:

Estimated ground loop thermal resistance (TR)=predicted ground loop thermal resistance value at a future site, Btu/hr-ft-° F.

Distance=total distance between known site and future site, ft

Known ground loop thermal resistance=known ground loop thermal resistance value as measured using the methods being presented, Btu/hr-ft-° F.

The estimated ground loop thermal resistance is a sum of the known ground loop thermal resistance values over the distance between the known site and the future site divided by a sum of the value 1 divided by the distance between the known sites and the future site.

The total distance between the known sites and future site is calculated as follows:

$$\text{Distance}=\sqrt{xy^2+z^2},$$

where:

xy=linear distance between known and future site, ft z=elevation difference between known and future site, ft For the information provided in the table above, the calculation would be:

$$\text{Estimated } TC = \frac{\left(\frac{0571}{\sqrt{10{,}877^2+46^2}}\right)+\left(\frac{0.610}{\sqrt{9{,}240^2+14^2}}\right)+\left(\frac{0.549}{\sqrt{8{,}712^2+110^2}}\right)+\left(\frac{0.535}{\sqrt{13{,}253^2+17^2}}\right)}{\left(\frac{1}{\sqrt{10{,}877^2+46^2}}\right)+\left(\frac{1}{\sqrt{9{,}240^2+14^2}}\right)+\left(\frac{1}{\sqrt{8{,}712^2+110^2}}\right)+\left(\frac{1}{\sqrt{13{,}253^2+17^2}}\right)} = 0.570 \text{ Btu}/hr\text{-ft-}^\circ\text{ F.}$$

As before, the calculation methodology being presented to predict ground loop thermal resistance at future sites may change to improve accuracy over time. Once the proposed system is installed and placed in service, its soil thermal conductivity value may also be measured, calculated, and added to the database for use in predicted values for additional future sites.

Figure 8:
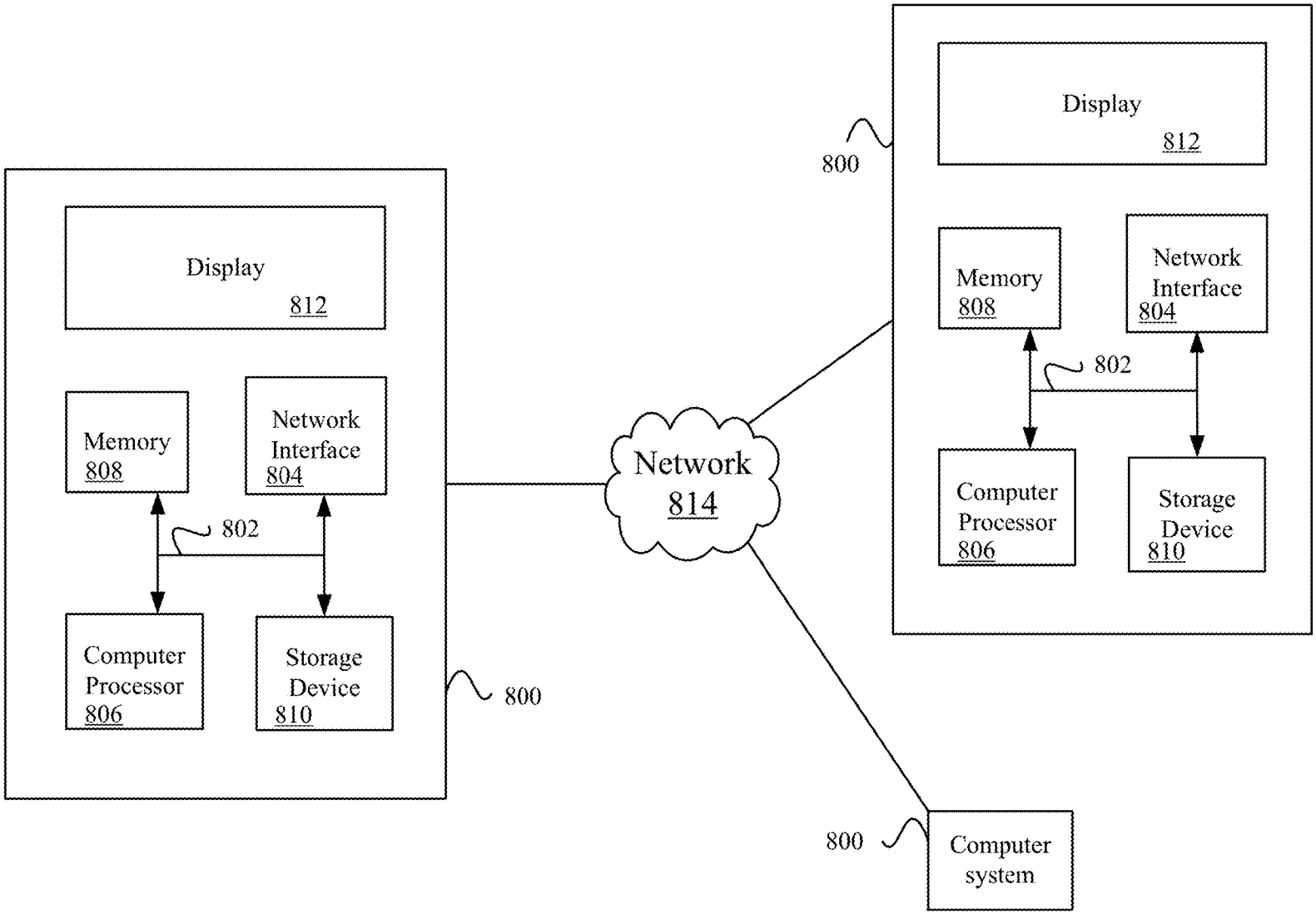
FIG. 8 illustrates an example of special purpose computer systems according to one embodiment.

FIG. 8 illustrates an example of special purpose computer systems 800 according to one embodiment. Computer system 800 includes a bus 802, network interface 804, a computer processor 806, a memory 808, a storage device 810, and a display 812.

Bus 802 may be a communication mechanism for communicating information. Computer processor 806 may execute computer programs stored in memory 808 or storage device 808. Any suitable programming language can be used to implement the routines of some embodiments including C, C++, Java, assembly language, etc. Different programming techniques can be employed such as procedural or object oriented. The routines can execute on a single computer system 800 or multiple computer systems 800. Further, multiple computer processors 806 may be used.

Memory 808 may store instructions, such as source code or binary code, for performing the techniques described above. Memory 808 may also be used for storing variables or other intermediate information during execution of instructions to be executed by processor 806. Examples of memory 808 include random access memory (RAM), read only memory (ROM), or both.

Storage device 810 may also store instructions, such as source code or binary code, for performing the techniques described above. Storage device 810 may additionally store data used and manipulated by computer processor 806. For example, storage device 810 may be a database that is accessed by computer system 800. Other examples of storage device 810 include random access memory (RAM), read only memory (ROM), a hard drive, a magnetic disk, an optical disk, a CD-ROM, a DVD, a flash memory, a USB memory card, or any other medium from which a computer can read.

Memory 808 or storage device 810 may be an example of a non-transitory computer-readable storage medium for use by or in connection with computer system 800. The non-transitory computer-readable storage medium contains instructions for controlling a computer system 800 to be configured to perform functions described by some embodiments. The instructions, when executed by one or more computer processors 806, may be configured to perform that which is described in some embodiments.

Computer system 800 includes a display 812 for displaying information to a computer user. Display 812 may display a user interface used by a user to interact with computer system 800.

Computer system 800 also includes a network interface 804 to provide data communication connection over a network, such as a local area network (LAN) or wide area network (WAN). Wireless networks may also be used. In any such implementation, network interface 804 sends and receives electrical, electromagnetic, or optical signals that carry digital data streams representing various types of information.

Computer system 800 can send and receive information through network interface 804 across a network 814, which may be an Intranet or the Internet. Computer system 800 may interact with other computer systems 800 through network 814. In some examples, client-server communications occur through network 814. Also, implementations of some embodiments may be distributed across computer systems 800 through network 814.

Some embodiments may be implemented in a non-transitory computer-readable storage medium for use by or in connection with the instruction execution system, apparatus, system, or machine. The computer-readable storage medium contains instructions for controlling a computer system to perform a method described by some embodiments. The computer system may include one or more computing devices. The instructions, when executed by one or more computer processors, may be configured to perform that which is described in some embodiments.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The above description illustrates various embodiments along with examples of how aspects of some embodiments may be implemented. The above examples and embodiments should not be deemed to be the only embodiments, and are presented to illustrate the flexibility and advantages of some embodiments as defined by the following claims. Based on the above disclosure and the following claims, other arrangements, embodiments, implementations and equivalents may be employed without departing from the scope hereof as defined by the claims.

What is claimed is:

1. A method comprising:

operating, by a computing device, a heat pump that uses a ground loop to perform heating or cooling in a site;

during the operating of the heat pump over a time period:

measuring, by the computing device, a first series of measurements of a ground loop water flow rate by the heat pump;

measuring, by the computing device, a second series of measurements of a ground loop fluid temperature for the heat pump;

measuring, by the computing device, a third series of measurements of a local soil or deep earth temperature; and outputting, by the computing device to a remote location from the site, the first measurement, the second measurement, and the third measurement, wherein a ground loop thermal resistance value is calculated at the remote location for the heat pump based on the first measurement, the second measurement, and the third measurement, wherein:

the first series of measurements and the second series of measurements are converted into a heat of extraction of the heat pump, the second series of measurements are converted into an average of the ground loop fluid temperature for the heat pump, and the heat of extraction and the average of the ground loop fluid temperature are used to calculate the ground loop thermal resistance value.

2. The method of claim 1, wherein the ground loop thermal resistance value is calculated using a heat of extraction of the heat pump, a length of the ground loop, the local soil or deep earth temperature, and an average of the ground loop fluid temperature for the heat pump.

3. The method of claim 2, wherein:

the heat of extraction is calculated based on the ground loop fluid flow rate from the first series of measurements, a first ground loop fluid temperature to enter the heat pump from the second series of measurements, and a second ground loop fluid temperature to leave the heat pump from the second series of measurements.

4. The method of claim 3, wherein:

the first ground loop fluid temperature to enter the heat pump is a minimum ground loop fluid temperature to enter the heat pump, and the second ground loop fluid temperature to leave the heat pump is a minimum ground loop fluid temperature to leave the heat pump.

5. The method of claim 4, wherein:

the minimum ground loop fluid temperature to enter the heat pump is while the heat pump is operating under peak heating or cooling conditions, and the minimum ground loop fluid temperature to leave the heat pump is while the heat pump is operating under peak heating or cooling conditions.

6. The method of claim 3, wherein the heat of extraction of the heat pump is further calculated based on a density of the ground loop fluid and a specific heat of the ground loop fluid.

7. The method of claim 6, wherein the heat of extraction is calculated based on:

multiplying the ground loop water flow rate by the density of the ground loop fluid and the specific heat of the ground loop fluid to generate a first result, and taking a difference between the minimum ground loop fluid temperature to enter heat pump and the minimum ground loop fluid temperature to leave heat pump, which is multiplied by the first result.

8. The method of claim 1, wherein:

an average ground loop fluid temperature for the heat pump is calculated based on the second series of measurements of the ground loop fluid temperature, and the average ground loop fluid temperature is used to calculate the ground loop thermal resistance value.

9. The method of claim 8, wherein:

the average ground loop fluid temperature is an average of a first ground loop fluid temperature to enter the heat pump and a second ground loop fluid temperature to leave the heat pump.

10. A method comprising:

operating, by a computing device, a heat pump that uses a ground loop to perform heating or cooling in a site;

during the operating of the heat pump over a time period:

measuring, by the computing device, a first series of measurements of a ground loop water flow rate by the heat pump;

measuring, by the computing device, a second series of measurements of a ground loop fluid temperature for the heat pump;

measuring, by the computing device, a third series of measurements of a local soil or deep earth temperature; and outputting, by the computing device to a remote location from the site, the first measurement, the second measurement, and the third measurement, wherein a ground loop thermal resistance value is calculated at the remote location for the heat pump based on the first measurement, the second measurement, and the third measurement, wherein:

the ground loop thermal resistance value for the heat pump comprises a first ground loop thermal resistance value for a first heat pump that is installed at a first location, and the first ground loop thermal resistance value for the first heat pump is used to predict a second ground loop thermal resistance value for a second heat pump that is installed at a second location.

11. The method of claim 10, wherein:

the first ground loop thermal resistance value is combined with one or more third ground loop thermal resistance values from one or more third heat pumps that are installed at one or more third locations to calculate the second ground loop thermal resistance value.

12. The method of claim 11, wherein the first thermal ground loop resistance value and the one or more third ground loop thermal resistance values are weighted with one or more distances from the first location to the second location and the one or more third locations to the second location.

13. A non-transitory computer-readable storage medium having stored thereon computer executable instructions, which when executed by a computing device, cause the computing device to be operable for:

operating a heat pump that uses a ground loop to perform heating or cooling in a site;

during the operating of the heat pump over a time period:

measuring a first series of measurements of a ground loop water flow rate by the heat pump;

measuring a second series of measurements of a ground loop fluid temperature for the heat pump;

measuring a third series of measurements of a local soil or deep earth temperature; and outputting to a remote location from the site, the first measurement, the second measurement, and the third measurement, wherein a ground loop thermal resistance value is calculated at the remote location for the heat pump based on the first measurement, the second measurement, and the third measurement, wherein:

the ground loop thermal resistance value for the heat pump comprises a first ground loop thermal resistance value for a first heat pump that is installed at a first location, and the first ground loop thermal resistance value for the first heat pump is used to predict a second ground loop thermal resistance value for a second heat pump that is installed at a second location.

14. The non-transitory computer-readable storage medium of claim 13, wherein:

the first ground loop thermal resistance value is combined with one or more third ground loop thermal resistance values from one or more third heat pumps that are installed at one or more third locations to calculate the second ground loop thermal resistance value.

15. The non-transitory computer-readable storage medium of claim 13, wherein the first thermal ground loop resistance value and the one or more third ground loop thermal resistance values are weighted with one or more distances from the first location to the second location and the one or more third locations to the second location.

16. The non-transitory computer-readable storage medium of claim 13, wherein the first ground loop thermal resistance value is calculated using a heat of extraction of the heat pump, a length of the ground loop, the local soil or deep earth temperature, and an average of the ground loop fluid temperature for the heat pump.

17. The non-transitory computer-readable storage medium of claim 16 wherein:

the heat of extraction is calculated based on the ground loop fluid flow rate from the first series of measurements, a first ground loop fluid temperature to enter the heat pump from the second series of measurements, and a second ground loop fluid temperature to leave the heat pump from the second series of measurements.

18. The non-transitory computer-readable storage medium of claim 17, wherein:

the first ground loop fluid temperature to enter the heat pump is a minimum ground loop fluid temperature to enter the heat pump, and the second ground loop fluid temperature to leave the heat pump is a minimum ground loop fluid temperature to leave the heat pump.

19. The non-transitory computer-readable storage medium of claim 18 wherein:

the minimum ground loop fluid temperature to enter the heat pump is while the heat pump is operating under peak heating or cooling conditions, and the minimum ground loop fluid temperature to leave the heat pump is while the heat pump is operating under peak heating or cooling conditions.

20. The non-transitory computer-readable storage medium of claim 17 wherein the heat of extraction of the heat pump is further calculated based on a density of the ground loop fluid and a specific heat of the ground loop fluid.

* * * * *